US005294162A

United States Patent [19]

Grimes

[11] Patent Number: 5,294,162

[45] Date of Patent: Mar. 15, 1994

[54] GRABBER APPARATUS

[76] Inventor: Gene Grimes, P.O. Box 162, Shaw, Miss. 38773

[21] Appl. No.: 980,341

[22] Filed: Nov. 23, 1992

[51] Int. Cl.[5] ..... B66C 1/42

[52] U.S. Cl. ..... 294/110.1; 294/3; 294/65.5; 294/85; 294/118

[58] Field of Search ..... 294/1.1, 2, 3, 24, 191.1-19.3, 294/65.5, 66.1, 82.1-82.12, 82.32, 85, 86.27, 107-109, 110.1, 111, 112, 117, 118, 120, 122-124; 242/77, 96, 117; 254/266, 380, 401

[56] References Cited

U.S. PATENT DOCUMENTS

| | | | |
|---|---|---|---|
| 435,590 | 9/1890 | Saxon | 294/86.27 |
| 472,436 | 4/1892 | Cornelius | 294/110.1 |
| 490,866 | 1/1893 | Fitzsimmons | 294/112 |
| 790,106 | 5/1905 | Chubb | 294/85 X |
| 845,555 | 2/1907 | Langley | 294/110.1 |
| 1,008,724 | 11/1911 | Lenderman | 294/110.1 |
| 1,039,737 | 10/1912 | Hester | 294/109 X |
| 1,111,338 | 9/1914 | Watson | 294/110.1 |
| 1,452,679 | 4/1923 | Fisher | 294/110.1 X |
| 1,796,197 | 3/1931 | Galbraith | 294/19.3 X |
| 2,515,292 | 7/1950 | Carr | 294/65.5 |
| 2,579,812 | 12/1951 | Fisher | 294/19.3 |
| 2,757,953 | 8/1956 | Kinkel | 294/110.1 |
| 3,041,102 | 6/1962 | Day | 294/19.3 |
| 3,348,872 | 10/1967 | Kolinski | 294/110.1 |
| 4,938,516 | 7/1990 | Temple | 294/65.5 X |

FOREIGN PATENT DOCUMENTS

| | | | |
|---|---|---|---|
| 1040514 | 10/1953 | France | 294/110.1 |
| 113557 | 3/1945 | Sweden | 294/19.3 |
| 1470647 | 4/1989 | U.S.S.R. | 294/110.1 |
| 185588 | 9/1922 | United Kingdom | 294/110.1 |

*Primary Examiner*—Johnny D. Cherry
*Attorney, Agent, or Firm*—S. Michael Bender

[57] ABSTRACT

A new and improved grabber apparatus includes first and second clamping arms having clamping fingers, a pivot for the clamping arms permitting them to move back and forth from a clamping to a non-clamping orientation, a spring for biasing the clamping arms in a closed orientation, a trigger for retaining the clamping arms in an open orientation, and idler bars connected to the clamping arms. A flexible cord is connected to the idler arms. A person, such as a hunter, who is in an elevated location, such as on a platform in a tree, can lower the grabber apparatus with the flexible cord using an unwinding and winding device. When the clamping arms are above and near an object to be clamped, they are lowered so that the trigger contacts a solid object near the object to be clamped, within the range of the clamping arms in the open position. Upon contacting the solid object, such as the ground near the object to be clamped, the trigger is actuated, the clamping arms are released from their open position, and the bias spring causes the clamping arms to move to the closed position and to grab the object to be clamped.

7 Claims, 4 Drawing Sheets

GRABBER APPARATUS

BACKGROUND OF THE INVENTION

1. Field of the Invention

The present invention relates generally to clamping devices that are used to grab and carry miscellaneous items, and more particularly, to a grabber apparatus especially adapted to grab and carry items from a location remote from and above the items.

2. Description of the Prior Art

Devices designed to grab and carry miscellaneous items are well known in the art. For example, U.S. Pat. No. 3,986,745 of Langguth discloses a grabber that has a trigger mechanism and that is carried by a marine mammal to a heavy object to be retrieved by a hoist line. Although this grabber is placed on an object at a location remote from a human operator, the human operator is not in control of placement of the grabber. It would be desirable, therefore, if a grabber could be controlled directly by a human operator to be placed near a remote object to be grabbed.

U.S. Pat. No. 4,249,344 of Pratt discloses a device for grabbing a plant having a root system confined in a ball of earth. A flexible strip is placed around the ball of earth in belt-like fashion, and the strip is wound to tightly grip the ball. However, many objects that may be grabbed, because of their shape and size, are not capable of being surrounded by a belt-like grabber. Instead, many objects are more amenable to being grabbed by a grabber which includes two opposing jaws. In this respect, it would be desirable if a grabber that has opposing jaws could be controlled directly by a human operator from a remote location.

U.S. Pat. No. 4,730,864 of Sample discloses an arm mounted, hand operated leaf and trash grabber that has two rake like gathering heads. A hand operated grabber does not permit remote operation of the grabber.

U.S. Pat. No. 4,815,779 of Glessner et al discloses an apparatus for picking up a smooth flat mechanical part by using a vacuum system. The vacuum system requires the use of complex vacuum-generating equipment, and for the vacuum to be effective, it requires that the object being picked up have a surface susceptible of forming a vacuum seal.

U.S. Pat. No. 4,962,957 of Traber discloses a hand-actuated pick-up tool that has pick-up fingers that are biased apart by springs and that are clamped together by hand pressure. As mentioned above, a hand operated grabber does not permit remote operation of the grabber. Moreover, for a remotely controlled grabber, it would be desirable if the grabber jaws were biased to close, not open, the grabber so that once the grabber was closed, it would exert a steady grabbing force on the object being grabbed.

Another situation begs for the use of a grabber. When a hunter, such as a bow hunter, stays in an elevated stand in a tree, if the hunter drops something which falls on the ground, the hunter would not be able to retrieve such fallen items unless he climbs down the tree. It would be desirable, therefore, if the hunter could remotely retrieve such fallen items without climbing down from the tree. A remotely controlled grabber would be desirable in such a case.

Thus, while the body of prior art discussed above indicates it to be well known to use hand-operated grabbers, remotely operated grabbers that are controlled by marine animals, complex vacuum-employing grabbers, and belt-containing grabbers, the provision of a more simple and cost effective grabber apparatus is not contemplated. Nor does the prior art described above teach or suggest a remotely-controlled grabber apparatus that is controlled directly by a human operator and that has spring-biased, opposing jaws that clamp on the grabbed object with grabbing pressure exerted by the biasing spring. The foregoing disadvantages in the prior art are overcome by the unique grabber apparatus of the present invention as will be made apparent from the following description thereof. Other advantages of the present invention over the prior art also will be rendered evident.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved grabber apparatus which has all of the advantages of the prior art and none of the disadvantages.

It is another object of the present invention to provide a new and improved grabber apparatus which may be easily and efficiently manufactured and marketed.

It is a further object of the present invention to provide a new and improved grabber apparatus which is of durable and reliable construction.

An even further object of the present invention is to provide a new and improved grabber apparatus which is susceptible of a low cost of manufacture with regard to both materials and labor, and which accordingly is then susceptible of low prices of sale to the consuming public, thereby making such grabber apparatus available to the buying public.

Still yet a further object of the present invention is to provide a new and improved grabber apparatus that can be controlled directly by a human operator to be placed near a remote object to be grabbed.

Yet another object of the present invention is to provide a grabber apparatus that has opposing jaws or arms that can be controlled directly by a human operator.

Still another object of the present invention is to provide a grabber apparatus which includes grabber jaws or arms that are biased to close the grabber so that once the grabber is closed, the jaws or arms exert a steady grabbing force on the object being grabbed.

Yet another object of the present invention is to provide a grabber apparatus which enables a person who is on an elevated platform in a tree, to remotely retrieve items which have fallen to the ground without climbing down the tree.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
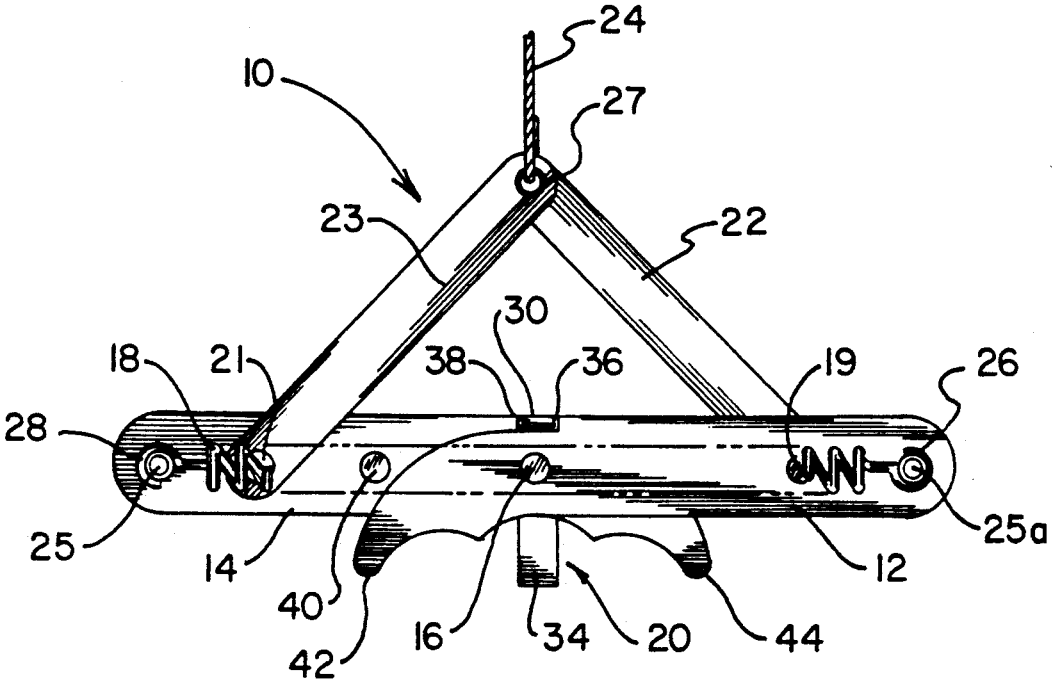
FIG. 1 is a side view showing a first preferred embodiment of the grabber apparatus of the invention in the open position.

With reference to the drawings, a new and improved grabber apparatus embodying the principles and concepts of the present invention will be described.

Turning initially to FIGS. 1–4, there is shown a first exemplary embodiment of the grabber apparatus of the invention generally designated by reference numeral 10. In its preferred form, grabber apparatus 10 is comprised of first clamping arm 12, second clamping arm 14, first pivot 16, spring 18, trigger 20, idler arms 22 and 23, and flexible cord 24. The first pivot 16 is connected to the rigid clamping arms 12 and 14 to permit the clamping arms to be interchangeably oriented in an open position and a closed position. The spring 18 includes a first spring end 26 and a second spring end 28. The first spring end 26 is connected to a post 25 on the first clamping arm 12, and the second spring end 28 is connected to a post 25*a* on the second clamping arm 14. The spring 18 provides a closing force for moving the clamping arms 12 and 14 from the open position (shown in FIG. 1) to the closed position (shown in FIG. 3).

Figure 3:
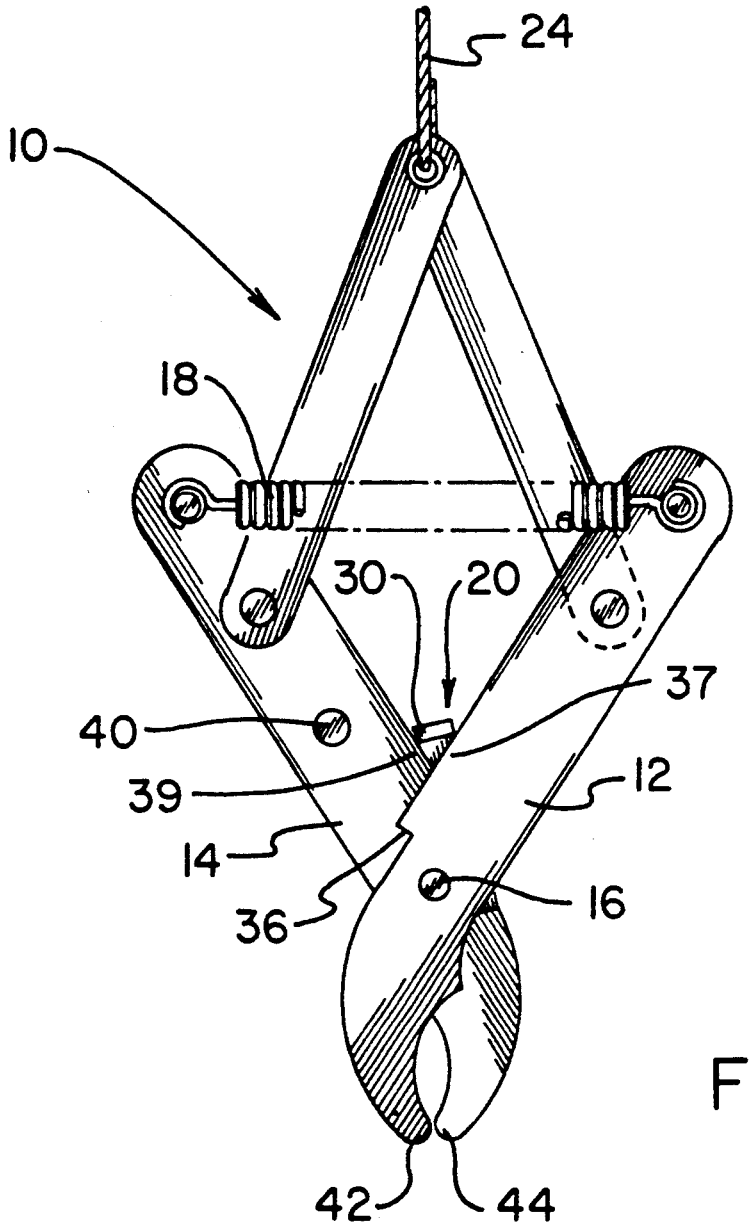
FIG. 3 is a side view showing the first preferred embodiment of the grabber apparatus of the invention shown in FIG. 1 in the closed position.
Figure 4:
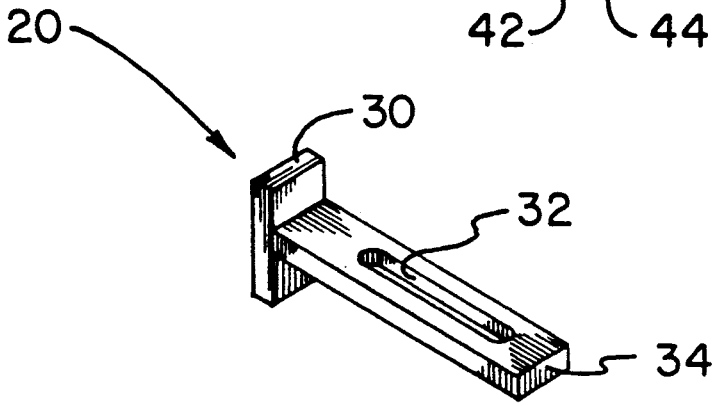
FIG. 4 is a perspective view of the trigger device used with the embodiment of the grabber apparatus of the invention shown in FIG. 1.

The trigger 20 is rigid and is in contact with the clamping arms 12 and 14 for retaining the clamping arms 12 and 14 in the open position. Movement of the trigger 20 releases the clamping arms 12 and 14, permitting them to move to the closed position. More specifically, (as also shown in FIG. 4), the trigger 20 includes a stop portion 30, a guide portion 32, and a trip portion 34. The trigger 20 has a first operating position (shown in FIG. 1) and a second operating position (shown in FIG. 3) with respect to the first and second clamping arms 12 and 14.

Figure 2:
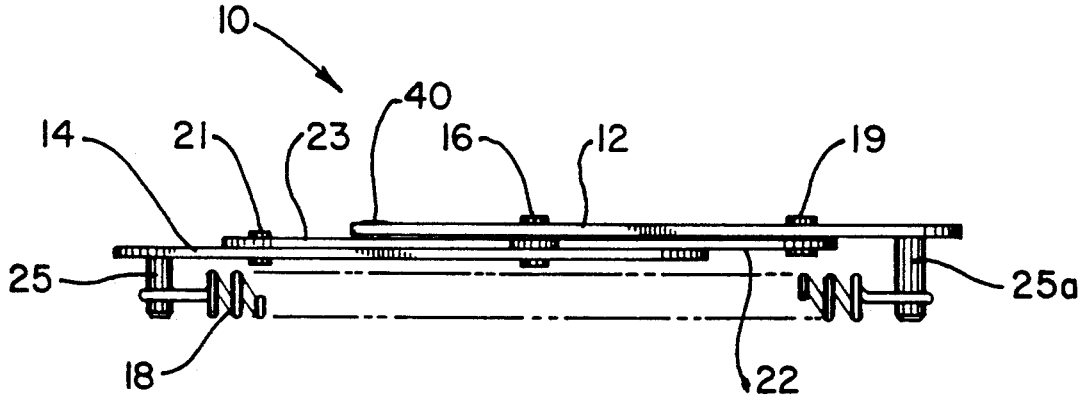
FIG. 2 is a bottom elevational view of the embodiment of the grabber apparatus of the invention shown in FIG. 1.

When the clamping arms 12 and 14 are in the open position, the trigger 20 is in its first operating position. As shown in FIGS. 1 and 2, in the first operating position of the trigger 20, the stop portion 30 is engaged with the trigger-reception regions of the clamping arms 12 and 14 and prevents the clamping arms 12 and 14 from moving from the open position to the closed position. The trigger-reception regions of clamping arms 12 and 14 include complementary respective first and second notches 36 and 38. The guide portion 32 is in contact with the first pivot 16 in the first position, and the trip portion 34 is in an untripped first position extending away from the clamping arms 12 and 14, permitting the trip portion 34 to contact an object below the clamping arms 12 and 14.

When the clamping arms 12 and 14 are in the closed position, the trigger 20 is in its second operating position. As shown in FIG. 3, in the second operating position of the trigger 20, which is obtained after the trip portion 34 has been pushed up by an object (such as the ground) below the clamping arms 12 and 14, the trip portion 34 is in a tripped or second position, whereby the clamping arms 12 and 14 are permitted to close (as shown in FIG. 3). In FIG. 3, the guide portion 32 is in contact with the first pivot 16 in a second position. The second position for the guide portion 32 is above its first position with respect to the first pivot 16. Also, the stop portion 30 is in a second position which is disengaged from notches 36 and 38 on the clamping arms 12 and 14, whereby the clamping arms 12 and 14 are permitted to move from the open position to the closed position by a closing force exerted by the spring 18. When the grabber apparatus 10 is in the closed position, the spring 18 exerts a constant pressure on any object which is grabbed by the apparatus.

The second clamping arm 14 includes a limit member 40 which limits a degree of openness when the clamping arms 12 and 14 are in the open position. In addition, the first and second clamping arms 12 and 14 include respective fingers 42 and 44 for directly clamping onto an object after the trigger 20 has been triggered. Rigid idler arms 22 and 23 are connected to respective second and third pivots 19 and 21 on clamping arms 12 and 14; and flexible cord 24 is connected to the idler arms 22 and 23 by being passed through respective orifices 27 of the idler arms 22 and 23 which are in registration.

Figure 8:
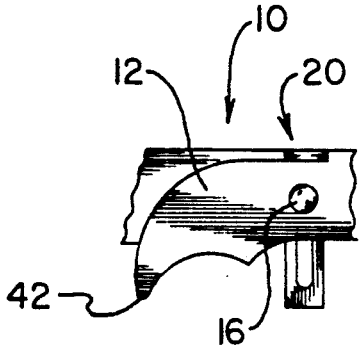
FIG. 8 shows a magnet-containing cap that can be placed over a finger end of a clamping arm.
Figure 8:
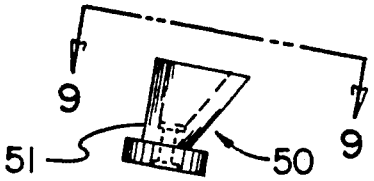
Figure 9:
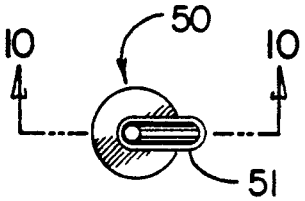
FIG. 9 is a top elevational view, taken along line 9—9 in FIG. 8, of the magnet-containing cap.
Figure 10:
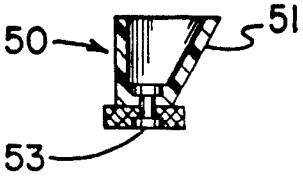
FIG. 10 is a cross-sectional view, taken along line 10—10 in FIG. 9, of the magnet-containing cap.

As shown in FIGS. 8, 9, and 10, the grabber apparatus 10 of the invention can further include magnet-containing caps 50 that fit over a finger 42 of the clamping arm 12. The caps 50 include a resilient housing 51 and a magnetic rivet 53. The resilient housing 51 fits tightly over the finger 42 of the clamping arm 12.

As shown in FIG. 3, when the grabber apparatus 10 of the invention is in the closed position, the fingers 42 and 44 are substantial opposed from one another when no object is clamped between the fingers 42 and 44. Alternatively, when the clamping arms 12 and 14 are in the closed position, and an object is not clamped between the finger 42 and 44, the finger portions may overlap.

The position that the fingers 42 and 44 assume when the grabber apparatus 10 is in the closed position, without grabbing an object may be controlled by the stop portion 30 of the trigger 20. More specifically, as shown in FIG. 3, when the grabber apparatus 10 is in the closed position, the stop portion 30 is no longer in contact with the first and second notches 36 and 38 of the clamping arms 12 and 14 and, instead, is squeezed between other topside portions 37 and 39 of the clamping arms 12 and 14. In this respect, the stop portion 30 serves as a limit, preventing further closure of the clamping arms 12 and 14.

Figure 7:
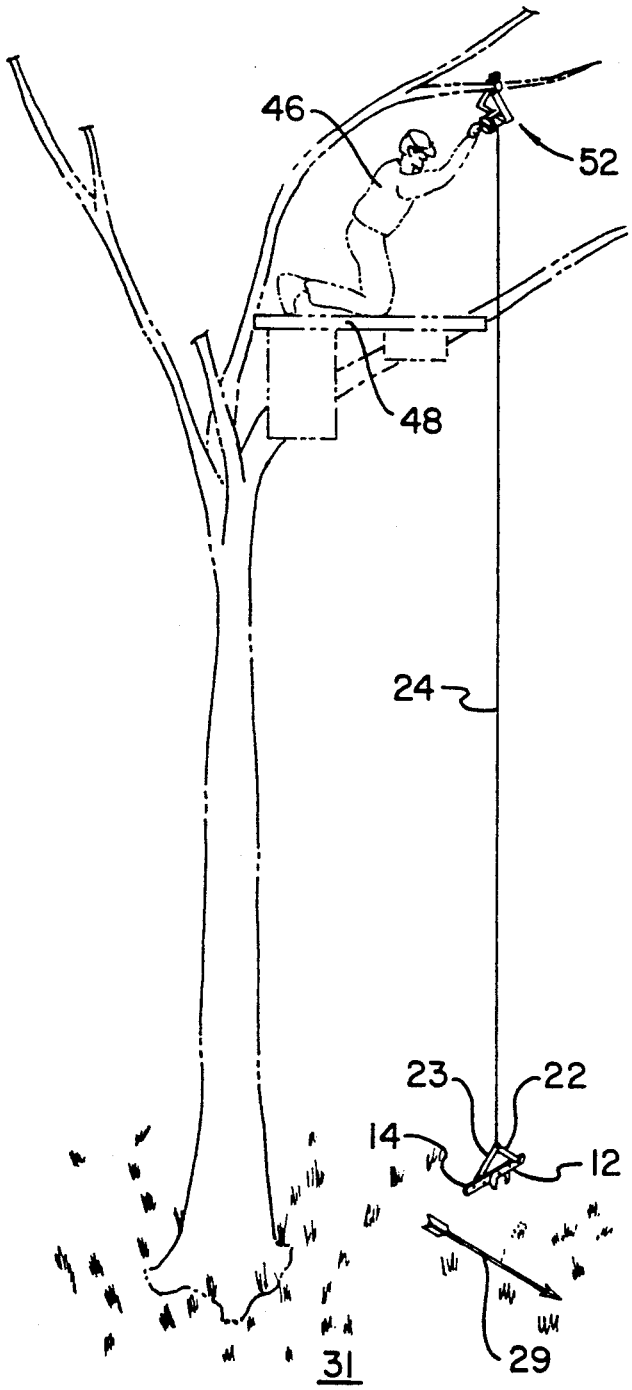
FIG. 7 is a perspective view showing an operator in a tree employing a second preferred embodiment of the grabber apparatus of the invention in preparation to retrieve an arrow lying on the ground, wherein the second preferred embodiment employs the line winder and unwinder shown in FIG. 5.

Turning to FIG. 7, a second embodiment of the grabber apparatus 10 of the invention is shown. In FIG. 7, reference numerals are shown that correspond to like reference numerals that designate like elements shown in the other figures. As shown in FIG. 7, the flexible cord 24, in conjunction with the idler arms 22 and 23, enable an operator 46, located above the clamping arms 12 and 14 on a tree platform 48, to raise, lower, and laterally move the clamping arms 12 and 14 so that the trigger 20 can be put in a position to contact a portion of the ground 31 near an arrow 29, within the range of the clamping arms in the open position, to clamp the arrow 29. The operator 46 can employ a hand-operated assembly 52 for lifting and moving the clamping arms 12 and 14. More specifically, the hand-operated assembly 52 is for winding and unwinding the flexible cord 24.

Figure 5:
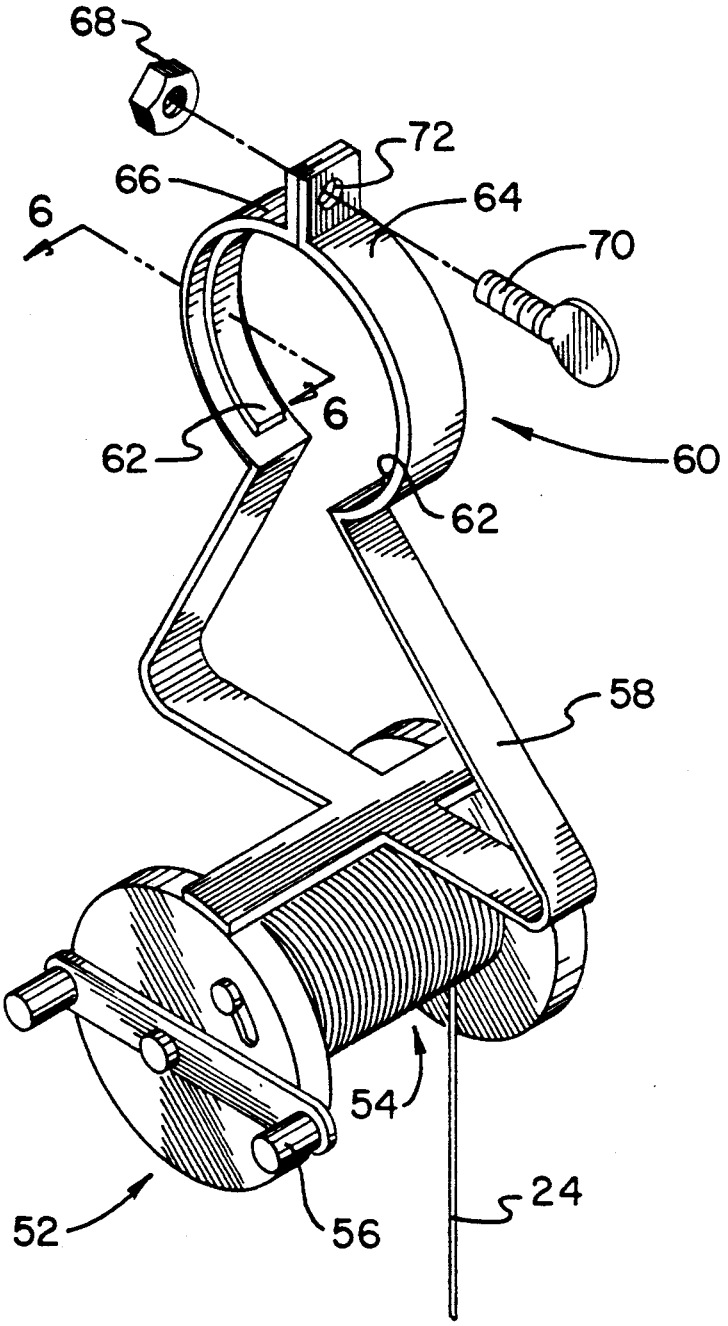
FIG. 5 is a perspective view of a line winder and unwinder that is used with the embodiment of the invention shown in FIG. 7.
Figure 6:
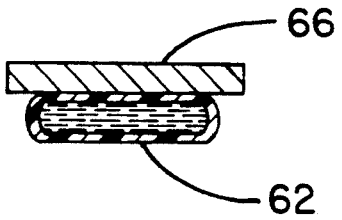
FIG. 6 is a cross-sectional view of an overhead suspension element taken along the line 6—6 in FIG. 5.

Turning to FIG. 5, reference numerals are shown that correspond to like reference numerals that designate like elements shown in the other figures. As shown in FIG. 5, the hand-operated assembly 52 includes a rotatable drum 54 for winding and unwinding flexible cord 24, a handle 56 for rotating the drum 54, a bracket 58 for holding the drum 54, and an overhead support element 60 that is integrally formed as part of the bracket 58. The overhead support element 60 is specially adapted to encircle a tree limb so that the overhead support element 60 can support the entire grabber apparatus 10 of the invention. To protect a tree limb from contact with hard metal, which is the material from which the rigid parts of the grabber apparatus of the invention are preferably fabricated, pads 62 are installed in the interior side of the overhead support element 60.

More specifically, as shown in FIG. 5, the overhead support element 60 is comprised of two separable, semi-circular portions 64 and 66 which can be spread apart to enable partial encirclement of tree limbs that have an outer diameter that is greater than the inner diameter of the overhead support element when in the unseparated orientation shown in FIG. 5. Whether the semi-circular portions 64 and 66 are unseparated or separated, nut 68 and bolt 70 are employed to secure the semi-circular portions 64 and 66 together. More specifically, the threaded portion of bolt 70 is passed through respective orifices 72 that are in registration. Then the nut 68 is secured to the bolt 70.

It is apparent from the above that the present invention accomplishes all of the objects set forth by providing a new and improved grabber apparatus that is low in cost, relatively simple in design and operation, and which may advantageously be used.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A grappler apparatus, comprising:

first and second clamping arms which include trigger-reception regions, first pivot means, connected to said clamping arms, for permitting said clamping arms to be interchangeably oriented in an open position and a closed position, spring means, including a first spring end and a second spring end, said first spring end connected to said first clamping arm and said second spring end connected to said second clamping arm, said spring means for providing a closing force for moving said clamping arms from the open position to the closed position, trigger means, in contact with said trigger-reception regions of said clamping arms, for retaining said clamping arms in the open position and for releasing said clamping arms and permitting said clamping arms to move to the closed position, wherein said trigger means includes a stop portion, a guide portion, and a trip portion, said trigger means having a first operating position and a second operating position with respect to said first and second clamping arms, in said first operating position of said trigger means, said stop portion is in a first position which is engaged with said trigger-reception regions of said clamping arms and prevents said clamping arms from moving from the open position to the closed position, said guide portion is in contact with said first pivot means in a first position, and said trip portion is in an untripped first position extending away from said clamping arms, permitting said trip portion to contact an object below said clamping arms, in said second operating position of said trigger means, obtained after said trip portion has been pushed up by an object below said clamping arms, said trip portion is in a tripped or second position which is out of engagement with said trigger-reception regions of said clamping arms whereby said clamping arms are permitted to close, said guide portion is in contact with said first pivot means in a second position, which is above said first contact position with said first pivot means, and said stop portion is in a second position which is disengaged from said trigger-reception regions of said clamping arms, whereby said clamping arms are permitted to move from the open position to the closed position by a closing force exerted by said spring means, wherein said stop portion of said trigger means is engaged with topside portions of said clamping arms when said clamping arms are oriented in the closed position, such that said stop portion serves as a first limit stop member for closure of said clamping arms in the closed position, and wherein one of said first and second clamping arms includes a second limit stop member adapted to engage the other of said clamping arms to limit the degree of openness when said clamping arms are in the open position.

2. The apparatus described in claim 1 wherein said first and second clamping arms include finger portions for directly clamping onto an object after said trigger means has been triggered.

3. The apparatus described in claim 2, further including magnet-containing caps that fit over said finger portions of said clamping arms.

4. The apparatus described in claim 1 further comprising lifting means, connected to said clamping arms, for enabling an operator located above said clamping arms to raise, lower, and laterally move said clamping arms or an object clamped by said clamping arms, wherein said lifting means includes:

a flexible line operated by an operator, and idler bars connected between said flexible line and said first and second clamping arms.

5. The apparatus described in claim 4, further including hand-operated means for winding and unwinding flexible line for lifting and lowering said clamping arms.

6. The apparatus described in claim 5 wherein said hand-operated winding and unwinding means includes:

a rotatable drum for winding and unwinding said flexible line, a handle for rotating said drum, a bracket from holding said drum, means for connecting said bracket to an overhead support, and an overhead support.

7. The apparatus described in claim 6 wherein said means for connecting said bracket to an overhead support includes means for suspending said hand-operated winding and unwinding means from a tree limb.

* * * * *